US006725687B2

(12) United States Patent
McCann et al.

(10) Patent No.: US 6,725,687 B2
(45) Date of Patent: Apr. 27, 2004

(54) DRINK DISPENSING SYSTEM

(75) Inventors: Gerald P. McCann, Los Angeles, CA (US); Donald J. Verley, Lake Hughes, CA (US)

(73) Assignee: McCann's Engineering & Mfg. Co., Los Angeles, CA (US)

( * ) Notice: Subject to any disclaimer, the term of this patent is extended or adjusted under 35 U.S.C. 154(b) by 0 days.

(21) Appl. No.: 10/237,165

(22) Filed: Sep. 6, 2002

(65) Prior Publication Data

US 2004/0045983 A1 Mar. 11, 2004

Related U.S. Application Data

(60) Provisional application No. 60/386,208, filed on May 16, 2002.

(51) Int. Cl.[7] ..... B67D 5/62

(52) U.S. Cl. ..... 62/389; 222/146.6; 261/DIG. 7; 417/301

(58) Field of Search ..... 62/389, 390, 393, 62/344, 396, 398, 399, 400; 222/146.6; 261/DIG. 7; 417/301, 307

(56) References Cited

U.S. PATENT DOCUMENTS

| | | | | |
|---|---|---|---|---|
| 3,011,681 A | | 12/1961 | Kromer | 222/1 |
| 3,162,323 A | | 12/1964 | Kromer | 222/1 |
| 3,215,312 A | | 11/1965 | Guzzi | 222/129.1 |
| 3,731,845 A | | 5/1973 | Booth | 222/67 |
| 3,813,010 A | | 5/1974 | Hassell et al. | 222/129.1 |
| 4,148,334 A | | 4/1979 | Richards | 137/389 |
| 4,304,736 A | | 12/1981 | McMillin et al. | 261/35 |
| 4,651,538 A | | 3/1987 | Bull et al. | 62/398 |
| 4,742,939 A | | 5/1988 | Galockin | 222/68 |
| 4,793,515 A | | 12/1988 | Shannon et al. | 222/69 |
| 4,850,269 A | * | 7/1989 | Hancock et al. | 99/323.1 |
| 4,928,854 A | | 5/1990 | McCann et al. | 222/129.1 |
| 5,413,742 A | * | 5/1995 | Gatter | 261/140.1 |
| 5,419,393 A | | 5/1995 | Guy, III | 165/168 |
| 5,484,015 A | | 1/1996 | Kyees | 165/168 |
| 5,765,726 A | * | 6/1998 | Jones | 222/129.1 |
| 5,839,291 A | * | 11/1998 | Chang | 62/126 |
| 5,855,296 A | | 1/1999 | McCann et al. | 222/61 |
| 6,196,418 B1 | | 3/2001 | McCann et al. | 222/61 |
| 6,394,311 B2 | | 5/2002 | McCann et al. | 222/61 |
| 6,401,981 B1 | | 6/2002 | McCann et al. | 222/129.1 |
| 6,505,758 B2 | * | 1/2003 | Black et al. | 222/146.6 |
| 6,560,972 B2 | * | 5/2003 | Ubidia | 62/59 |

FOREIGN PATENT DOCUMENTS

| | | | | |
|---|---|---|---|---|
| EP | 2308746 A | * | 9/1974 | 222/67 |

OTHER PUBLICATIONS

Servend International, Inc., Cold Carbonation Retro–Fit Kit brochure Feb. 2001, 2 pgs.
McCann's 1999 Price Book, Mar. 1999.
U.S. Patent Application Publication No. US 2002/0005413 A1, Jan. 17, 2002.
U.S. Patent Application Publication No. US 2003/0066306 A1, Apr. 10, 2003.

* cited by examiner

*Primary Examiner*—William C. Doerrler
*Assistant Examiner*—Mohammad M. Ali
(74) *Attorney, Agent, or Firm*—Fulbright & Jaworski, LLP

(57) ABSTRACT

A drink dispensing system having sets of faucet dispensers, ice storage bins adjacent to the sets of faucet dispensers, respectively, a common carbonator and circulation pumps associated with fluid circuits provide circulating flow through cold plates defining bottoms to the ice storage bins. Flow may be in parallel or in series to each of the separate stations. The circulating system is illustrated to be for the carbonated water supply while noncirculating supply systems provide noncarbonated water and syrup to the dispensing stations. Circulating systems for bar guns using a cold plate is also disclosed.

32 Claims, 5 Drawing Sheets

DRINK DISPENSING SYSTEM

This application claims priority from a provisional application No. 60/386,208, filed May 16, 2002.

BACKGROUND OF THE INVENTION

The field of the present invention is systems for dispensing carbonated beverages and the cooling of the supplied beverages.

Commercial establishments with drink dispensing systems employ a variety of mechanisms to create and dispense carbonated and noncarbonated beverages. Such systems generally associated with what may be termed fountain service typically generate the carbonated water from carbon dioxide and service water. The beverage ingredients, water, carbonated water and syrups, are then mixed at faucets upon demand. Mixing spouts associated with valves forming the faucets are disclosed in U.S. Pat. No. 4,928,854 and U.S. patent application Ser. No. 09/281,688, filed Mar. 30, 1999, the disclosures of which are incorporated herein by reference. In commercial systems, the dispensers are conveniently located proximate to an ice storage bin. However, the ingredients are frequently stored at a distance from the dispensing equipment.

In bar service, as opposed to fountain service, bar gun systems are more frequently employed. Such guns include a long flexible sleeve with conduits therein. The conduits are full of various ingredients for supply on demand through valves to a spout. Because of limited space, fluids in these tubes are not insulated. Bars employ a number of configurations from remote location of the supply to storage under the bar. Commonly, an ice bin is located near the bar gun as a further source of drink ingredients.

As an industry standard, it is preferred that the dispensing of beverages be at a lower temperature even though the beverages are typically poured over ice. This is particularly true of carbonated beverages where the amount of carbon dioxide which can be held by the liquid varies inversely with the temperature. The industry would like to keep carbonated water at the fountain to as close to 33° F. as possible and always below 40° F. Such systems conventionally use either a heat transfer system associated with the proximate ice storage bin or a mechanical refrigeration system for keeping the ingredients cold. Lines and tanks are frequently insulated to assist in keeping the chilled ingredients cold pending distribution.

In heat transfer systems, ice storage bins are provided with a cold plate forming the bottom of the bin. Coils are cast within the cold plate of the ice storage bins to effect heat transfer between ice within the bin and beverage ingredients flowing through the coils. Thus, certain of the various fluids combined to make beverages are chilled through these coils for distribution as beverage is drawn from the system. Beverage dispensing systems with a cold plate system now account for an estimated seventy to eighty-five percent of the fountain service dispensers used in the United States today. Bar gun systems also have employed cold plates in ice storage bins adjacent the dispenser for chilling carbonated water. A line from the cold plate extends to the gun parallel to syrup lines.

These cold plates can vary in size, depending on the desired number of soft drinks to be dispensed through a maximum use period. The plates have many feet of stainless steel tubing formed in very tight coils that are cast inside a block of aluminum. The aluminum block provides a heat exchange container. High capacity cold plates can be from two to five inches thick and of various sizes depending on the size of the ice storage bin and the cooling requirements. Bar gun systems typically require smaller cold plates than in-store drink dispensing systems.

There are separate cooling paths for carbonated water, plain water and each flavor of syrup when all are cooled. The carbonated water heat transfer systems can employ a single or double coil circuit in series for cooling in high demand systems. The coils for carbonated water can be as long as seventy feet while the syrup coils are generally much less, often twenty to forty feet. Further, the tubing making up the syrup coils is frequently ¼" ID while the tubing for the carbonated coils is larger, from 5/16" to ⅜" ID. The tubing is tightly arranged within the cold plate with tight bends.

The length of tubing and the circuitous coiling of the tubing in such cold plates can create a significant pressure drop in the flow therethrough. The pressure drop can be of concern to designers where multiple sets of dispensers are used with passes through multiple coil circuits in series. An excessive pressure drop can adversely affect the operation of the system during busy times as a certain level of pressure is demanded at the dispensers to insure adequate throughput. The industry typically wants a minimum of 40 psi at the back of each faucet for carbonated water and a minimum of 15 psi for syrup. At the same time, excessive carbonation resulting from high pressure in the carbonator can create a foaming problem. Excessive pressure drop through successive coil circuits can, therefore, require substantial pressure prior to the cooling process to achieve the required minimum pressure at the faucet. If carbon dioxide is introduced prior to the pressure drop under such conditions, excessive carbonation can result.

Cold plates currently employed are disclosed in U.S. Pat. Nos. 4,651,538, 5,419,393 and 5,484,015, the disclosures of which are incorporated herein by reference. These cold plates are much heavier in design than earlier such devices. The cold plate systems have increased in size as greater and greater volumes of beverage are consumed. Typical soft drink volumes have grown from six ounces in the past to as much as sixty-four ounces today. Depending on the design, even greater pressure drops can be experienced.

The performance of such systems employing a cold plate naturally depends on the rate at which the beverages are being dispensed. So long as there is ice in the ice storage bin, adequate cooling is typically accomplished under high volume flow. However, during periods when there is low demand, the stagnated liquids between the cold plate and the dispensers or bar gun can experience a temperature rise, referred to in the industry as a casual drink warm-up, as there is no further contact with the cold plate.

A prior cold plate system avoiding the issue of over carbonation and excessive plate size employed a cold water system which circulated through a cold plate. Upon demand, cold water was delivered to an on-the-fly carbonator after leaving the cold water system and then to the faucet. The cooling system was, therefore, a source of cold water to the carbonated beverage dispensing system and did not operate within the dispensing system itself.

The mechanically refrigerated beverage dispensing systems are used to a lesser extent than cold plate units. Mechanical refrigeration is more expensive and requires more frequent service. The faucets of systems using such mechanical refrigeration are still typically mounted over an ice storage bin used for the drinks. Such ice storage is not used to cool the carbonated beverage and does not include a cold plate system when using mechanical refrigeration.

Mechanical refrigeration systems typically circulate carbonated water to maintain an adequate reservoir of cooled supply. Even so, high volume flow can slowly tax the system with gradually increasing liquid temperatures with no recourse but to quit dispensing drinks rather than to just add more ice. When mechanical refrigeration systems fail, the system must be shut down pending repair rather than, again, just adding more ice.

Mechanically refrigerated cooling systems are principally employed with very high volume systems at substantial cost. Some disclosed systems are found in U.S. Pat. Nos. 3,011,681, 3,162,323, 3,215,312, 3,731,845, 3,813,010, 4,148,334, 4,304,736, 4,742,939 and 4,793,515, the disclosures of which are incorporated herein by reference.

Carbonated water is manufactured in stainless steel tanks varying in size from one quart to three or four gallons in commercial beverage dispensers. These tanks are generally pressurized at 60 to 110 psi by the carbon dioxide. The higher pressure requirements typically reflect higher water temperatures. Service water enters the tank as demanded. The level in the tank is controlled by a sensor and the supply is provided by an electric motor and pump assembly.

Systems can also employ water pressure boosters. Such boosters provide for a reservoir of pressurized water. They additionally may provide for a reservoir of carbonated water as well. Water pressure boosters can include a water chamber, a carbon dioxide pressurized or pressurized air chamber and a movable wall therebetween. The movable wall may be a bladder. The carbon dioxide pressurized chamber can also hold carbonated water with adequate liquid fill control. The boosters employ water pressure booster valves which respond to the amount of stored water in the water chambers. The valve directs water to the water chamber until a desired level is reached. Water is then directed to the carbonator. Both the booster and the carbonator can include switches to activate a supply pump for charging of the system. The booster and the carbonator functions accommodate a single supply pump and provide similarly pressurized carbonated and noncarbonated water to a beverage dispensing system. A booster combined with a carbonator is disclosed in U.S. Pat. Nos. 5,855,296 and 6,196,418, the disclosures of which are incorporated herein by reference.

In commercial systems, the carbonator is typically displaced from the dispensing system. The water is at ambient temperature and the carbon dioxide pressure is generally set at 90 psi to 100 psi. The volume of carbonation in the system is generally in the range of 5 to 6 volumes. As some carbonation is lost in the dispensing process, the initial level of carbonation before dispensing is typically higher than that in canned beverages. This overpressure accommodates the various conditions imposed by the dispensing system. However, the most problematic is the maintenance of low temperature within the beverage to be dispensed in order that stable carbonation can be maintained in the drink when dispensed. Extra pre-chillers and increased cooling coil footage have been employed to decrease the faucet temperature. Even so, the low volume casual drink usage remains problematic in cold plate systems.

SUMMARY OF THE INVENTION

The present invention is directed to drink dispensing systems employing dispensers served by circulating fluid circuits. Ice storage bins having cold plates and circulation pumps are arranged within the fluid circuits. Such circulating systems provide capacity in cold plate systems to dispense properly chilled beverages regardless of the rate of usage.

When multiple sets of dispensers and ice storage bins are employed, the fluid circuitry may provide series flow, parallel flow or a combination of the two between the multiple dispensing stations. Separate systems additionally can include noncarbonated water and sources of the various drink components.

Where very high dispensing flow is expected, return line backfill can also be provided to avoid pressure drops in the system. Pressure drops can result in carbon dioxide coming out of solution within the system. The increased capacity can be provided without increasing the flow capacity of the supply side of the circuit.

Accordingly, it is an object of the present invention to provide improved temperature maintenance in cold plate drink dispensing systems. Other and further objects and advantages will appear hereinafter.

DETAILED DESCRIPTION OF THE PREFERRED EMBODIMENTS

Figure 1:
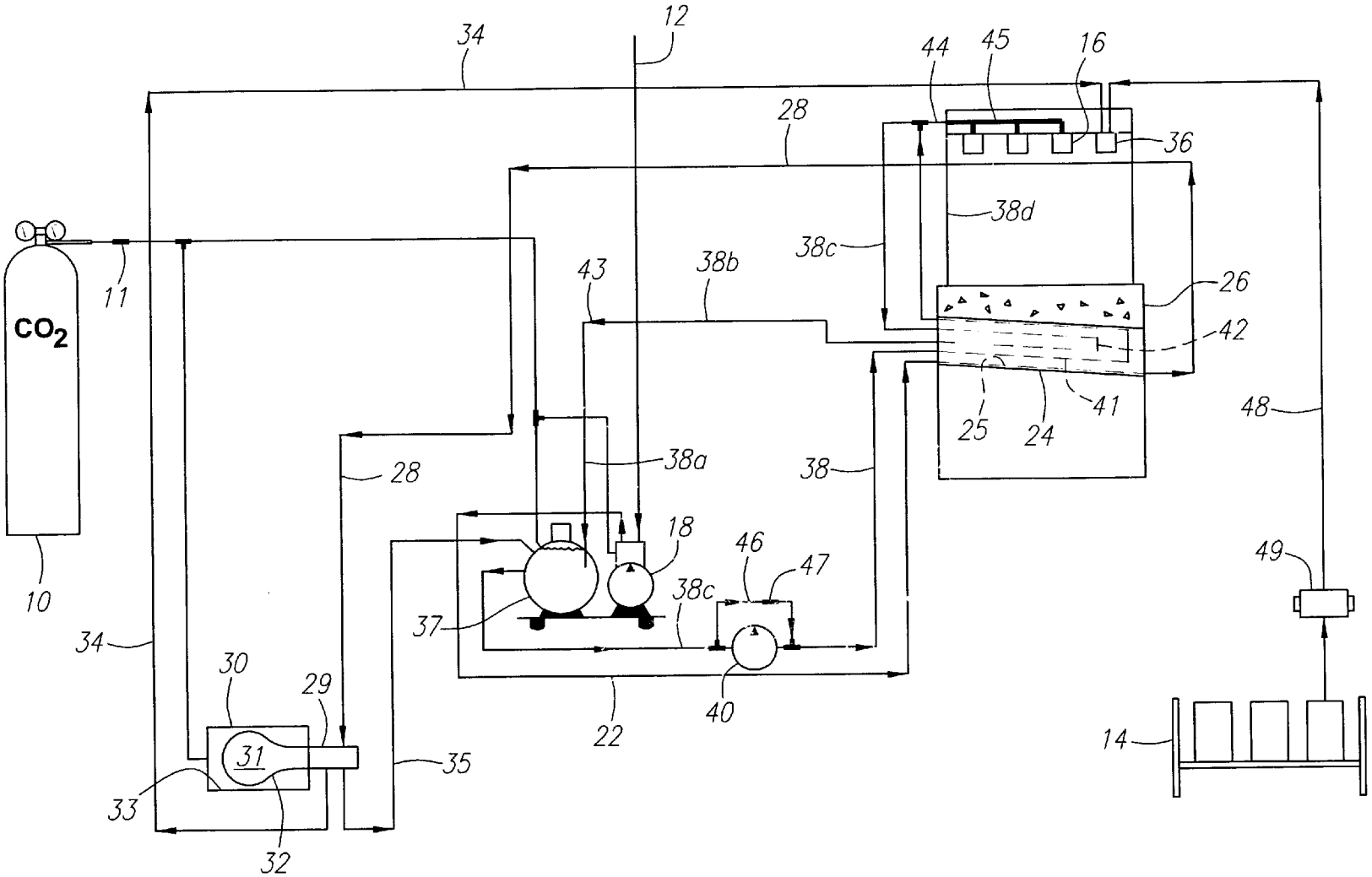
FIG. 1 is a schematic fluid circuit design for a single set of faucet dispensers.

Turning in detail to the figures, FIG. 1 illustrates a single dispensing station for both carbonated and noncarbonated beverages. The drink dispensing system is shown to include a source of carbon dioxide 10 protected by a check valve 11, a water inlet 12 and a source of syrups 14. From these, a plurality of carbonated and noncarbonated flavored drinks can be dispensed through the dispensers 16.

Water enters from the water inlet 12 to a supply pump 18 where the pressure is raised. The incoming water from the supply pump 18 may be directed through a water line 22 to a cold plate 24 if the water is to be chilled before carbonation. The cold plate 24 forms the bottom of an ice storage bin 26 and has conventional coils 25 therethrough to receive the incoming water from the water line 22. The water from the coils 25 of the cold plate 24 is then directed through a cold water line 28 to a water pressure booster valve 29 for selected distribution. Carbon dioxide, also under pressure, is introduced from the source of carbon dioxide 10 with the pressurized water from the supply pump 18 to the system.

A water pressure booster 30 is associated with the booster valve 29. The booster 30 includes a water chamber 31 on one side of a movable wall shown in this embodiment to be a bladder 32. On the other side of the movable wall, a carbon dioxide pressurized chamber 33 exerts pressure from the source of carbon dioxide 10 in fluid communication with the chamber 33. Thus, a reservoir under pressure is created in the water chamber 31 at the pressure of the carbon dioxide plus that contributed by the-resilience of the bladder 32. In addition, when water is added from the cold water line 28, the check valve 11 prevents carbon dioxide from flowing back to the source 10. Consequently, the pressure in the booster 30 increases with the additional volume of water added. This pressure will equalize throughout the system with operation, reducing the actual increase and maintaining equality at the dispensers. Commercial faucets typically compensate for normal system variations in pressure.

The booster valve 29 controls flow from the cold water line 28 into the water chamber 31 in communication with a pressurized cold water line 34 and into a pressurized cold water supply 35. The booster valve 29 includes a sensor coupled with the bladder 32 to determine the amount of water in the water chamber 31. When water is needed in the water chamber 31 within the bladder 32, the valve 29 directs water thereto. The water chamber 31 receives water from the water inlet 12 through the water line 22, the coils 25 of the cold plate 24 and the cold water line 28. When the water chamber 31 does not require water, the source of water is directed to the pressurized cold water supply 35.

To supply water under a controlled pressure, the supply pump 18 is used in the water inlet 12. The supply pump 18 is able to supply pressure above that of the source of carbon dioxide 10. As a need for water is sensed in the water chamber 31 or in the carbonated system, the supply pump 18 is activated. The pressure of the water through the pump 18 is raised to above that of the carbon dioxide source 10 to recharge the systems. The check valve 11 prevents water from flowing to the source of carbon dioxide 10 when the pump 18 raises the water pressure to above that of the carbon dioxide source 10. Thus, the cold water line 28, the booster 30 and booster valve 29 provide a source of pressurized cold water through the pressurized cold water line 34 and the pressurized cold water supply 35.

Water is directed through the pressurized cold water line 34 for distribution to a noncarbonated water faucet or set of faucets 36. As noncarbonated water is dispensed through the faucet 36, the bladder 32 contracts until the pump 18 is activated. At all times, the pressure delivered to the faucet 36 is at or a bit above the pressure of the carbon dioxide source 10.

When there is substantial demand for noncarbonated beverages, the water is chilled from heat transfer at the coils 25. The pressurized cold water line 34 is preferably insulated to maintain this chill. When the faucet 36 is experiencing low demand in a period when casual drinks are dispensed, the water to the faucet 36 can warm up some. However, as the water is noncarbonated and such drinks are poured over ice, the loss of chill is not an issue.

The pressurized cold water supply 35 supplies water from the booster valve 30 to a carbonator 37. The source of carbon dioxide 10 is also directed to the carbonator 37 where carbonated water is produced. The carbonator 37 includes a float sensor (not shown) to sense the water level and turn on the supply pump 18. The carbonator 37 is located within a fluid circuit 38.

The fluid circuit 38 includes a connector 38*a*, which may defined to either side of the carbonator 37 as a return portion 38*b* and a supply portion 38*c*, a supply 38*d* and a return 38*e*. A circulation pump 40 is in the supply portion 38*c*. Supply coils 41 through the cold plate 24 are located between the supply portion 38*c* of the connector 38*a* and the supply 38*d*. Return coils 42 through the cold plate 24 are located between the return 38*e* and the return portion 38*b* of the connector 38*a*. A supply line 44 extends from the fluid circuit 38 to the set of dispensers 16 between the supply coils 41 through the supply 38*d* and the return coils 42 through the return 38*e* to place the dispensers 16 in direct fluid communication with the coils in the cold plate 24. The dispensers 16 are joined by a manifold 45 which is directly connected to the supply line 44 and to each of the dispensers 16 of the set.

The manifold 45 may also be configured to have circulation flow therethrough. In this event, the manifold 45 is in the circuit and the dispensers 16 are in direct communication with the fluid circuit 38 in the manifold 45. This makes the volume between the fluid circuit 38 and the faucet valve (the space in which the carbonated water stagnates between drinks) very short. Additionally, substantial heat transfer between the manifold and the valve of the dispenser 16 will typically keep this small volume chilled with continuous circulation through the fluid circuit 38 of the chilled carbonated water.

As the supply line 44 is stagnant between drinks with a conventional manifold 45, it is preferred that the line 44 have as small a volume as possible so that the stagnant carbonated water in the line 44 will be thermally insignificant to the overall temperature of the drink dispensed, even when dispensing a casual drink where the line 44 has warmed to as high as room temperature. Indeed, the line 44 may be nothing more than a fitting between the fluid circuit 38 and the manifold 45. It may also be insulated. The ice storage bin 26 with the cold plate 24 is positioned proximate to the dispensers 16 for conveniently distributing both the beverages and ice. This proximity provides for reducing the length of the lines in either the fluid circuit 38 or the supply line 44.

For stagnant carbonated water to be thermally insignificant, the volume of the stagnant carbonated water must be small relative to the minimum volume drink expected typically to be dispensed. For fountain service, the minimum such typical drink approaches 12 oz. For bar service, the minimum is closer to 3 oz. Thus, the volume remaining thermally insignificant varies with application. With fountain service, a volume of 1½ oz. would leave room temperature stagnant carbonated water thermally insignificant to the typical minimum drink dispensed. In bar applications, such a volume would drop to about ⅓ oz. Circulating carbonated water through a cold plate is anticipated to achieve approximately 33° F. Industry standards contemplate dispensing carbonated water at or below 40° F. The volumes discussed above would result in a rise of far less than 7° F. in the total volume dispensed, even when the stagnant carbonated water has reached room temperature.

A bypass 46 extends around the circulation pump 40. The bypass 46 has a check valve 47 to prevent a short circuiting of flow through the bypass 46. The bypass 46 allows a supply of carbonated water around the pump 40 if the pump 40 is inhibiting certain levels of flow. The capacity of the circulation pump 40 is preferably under 35 gal./hr. as higher capacity pumps appear to provide less efficient results. The pump contemplated is a 15 gal./hr. positive displacement pump. The pump may be of the type having a cylindrical chamber with a non-concentric rotor therein with vanes radially movable in the rotor to sweep the volume of the cylinder.

To complete the schematic, syrup lines 48 extend from the source of syrup 14 to the dispensers 16 and to the noncarbonated water dispenser 36. A syrup pump 49 is associated with each line or the source of syrup can be pressurized. Only one such line 48 is illustrated but one per syrup flavor and corresponding faucet is contemplated.

In operation, the system of FIG. 1 supplies carbon dioxide, water and syrup on demand. The incoming water is cooled prior to introduction to the system through the cold plate 24. Such cooling is not essential to the operation, however, and may be skipped. Carbonated water is manufactured from the supplied carbon dioxide and cold water in the carbonator 37.

The fluid circuit 38 circulates the carbonated water from and to the carbonator 37 through the circulation pump 40.

The circulation pump 40 runs continuously during store hours to insure an optimum drink temperature that will preserve as much carbon dioxide in solution as practical with the pressure dropping to atmospheric, the ingredients being mixed and the result falling into a cup, typically with ice therein. A timer might be used to turn on and off the system in accordance with store hours. The timer might also be used to predict the amount of run time needed before the store opening in time to chill the carbonated water before first use.

The cold plate 24 provides cooling by transferring heat from the supply water and the carbonated water to the ice within the ice storage bin 26. A supply of ice is maintained in the ice storage bin 26 for drink service and for cooling the drink ingredients. When drinks are called for, the booster 30 and the carbonator 37 have an instant supply under the balanced pressure in the booster 30 and the carbonator 37. Additional water can be supplied to either as described above to make up for usage.

When heavy use is encountered, it is at least theoretically possible to lower the pressure within the fluid circuit 38, the supply line 44 or the manifold 45 to the point that carbon dioxide will prematurely come out of solution from the carbonated water. However, the supply 38*d* and the return 38*e* are equally capable of supplying carbonated water to the supply line 44 and the manifold 45 as the return 38*e* permits flow in both directions. The return portion 38*b* as well as the supply portion 38*c* extend into the carbonator 37 toward the bottom thereof to insure the drawing of liquid rather than carbon dioxide. Thus, the actual supply capability from the carbonator to the dispensers 16 is effectively doubled upon demand.

Figure 2:
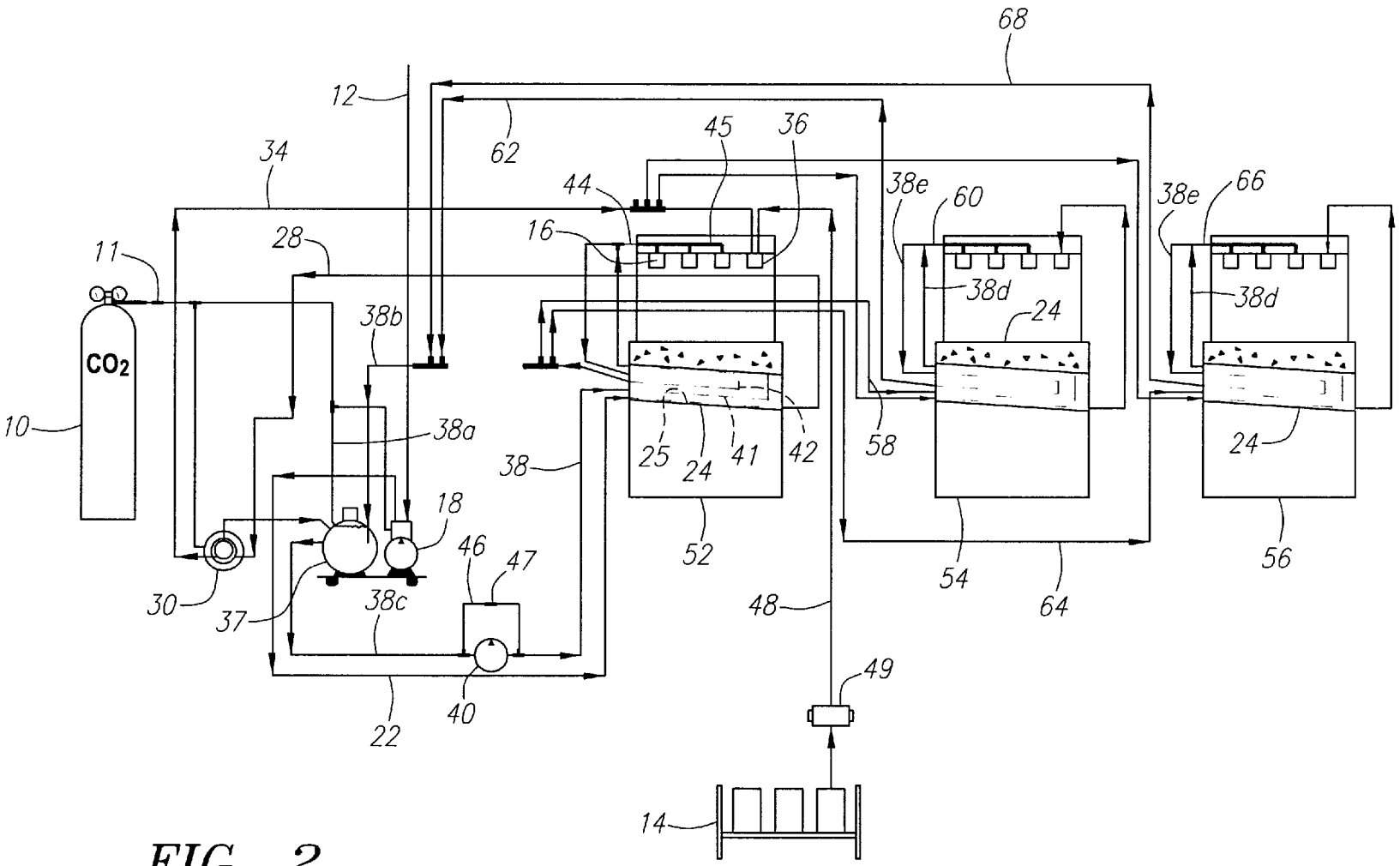
FIG. 2 is a schematic fluid circuit design for three sets of faucet dispensers.

FIG. 2 illustrates a system having three sets of faucet dispensers. Like reference numbers with the embodiment of FIG. 1 reflect like elements. This system uses two cold plates 24 in series for each of the two flow paths as well be described. With two cold plates 24, hot environments that the system might encounter could be accommodated. In this embodiment, the first station 52 dispensing ice and beverage is in series with each of a second station 54 and a third station 56. In this arrangement, the carbonated water never passes through more than two sets of coils in each of two cold plates 24. With this, pressure losses are not excessive. Only one circulation pump 40 is employed and a balancing of the circulation rates to the stations 54 and 56 is considered. The schematic only illustrates one source of syrup 14, in like manner to FIG. 1, but two others are contemplated, one for each additional station. The downstream stations 54 and 56 get about one-half of the cooling flow of the upstream station 52. Even so, less cooling is required of the supply through the second and third stations because the carbonated water was chilled through the first station and already starts out cold. The second and third stations are typically located where there is less demand and these stations act even more efficiently at cooling the carbonated water flowing therethrough.

A second station supply portion 58 is in communication with the coils of the cold plate 24 of the first station 52 and supplies the coils of the cold plate 24 at the second station 54. A second supply line 60 is in direct fluid communication with the coils of the cold plate 24 associated with the second station 54. A second station return portion 62 completes the branch circuit by circulating the cold carbonated water to the return portion 38*b*. In an identical manner, a branch circuit is presented to the third station 56, including a third station supply portion 64, a third supply line 66 and a third station return portion 68.

Figure 3:
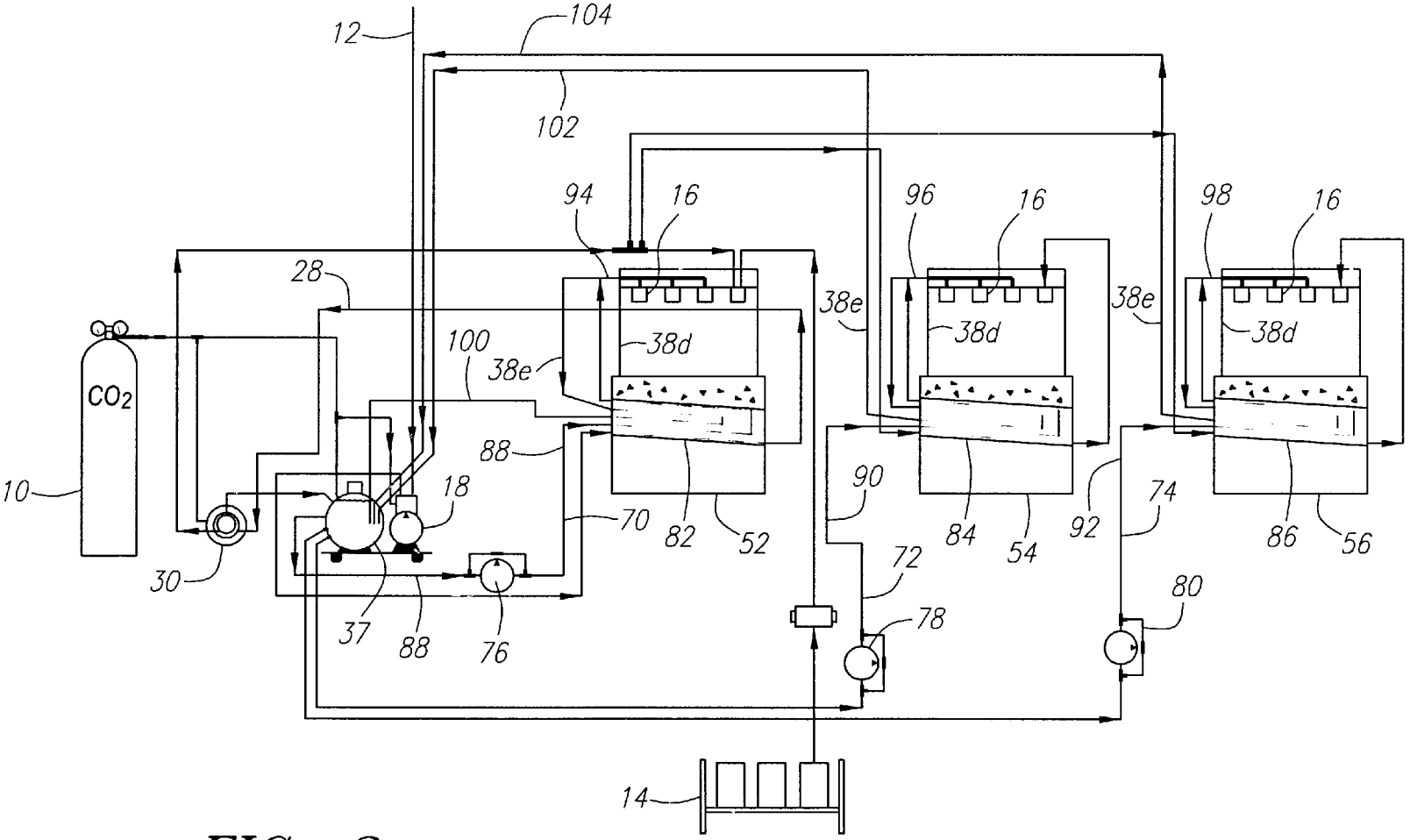
FIG. 3 is a schematic fluid circuit design for an alternate embodiment for three sets of faucet dispensers.

FIG. 3 illustrates a fully parallel system with three fluid circuits 70, 72, 74. Each returns to the same carbonator 37 but each has a separate circulation pump 76, 78, 80 and a separate cold plate 82, 84, 86. By employing such parallel fluid circuits 70, 72, 74, the operation is identical for each station 52, 54, 56 as that described for the system of FIG. 1. These circuits 70, 72, 74 have station supply portions 88, 90, 92, supply lines 94, 96, 98 and return portions 100, 102, 104.

Figure 4:
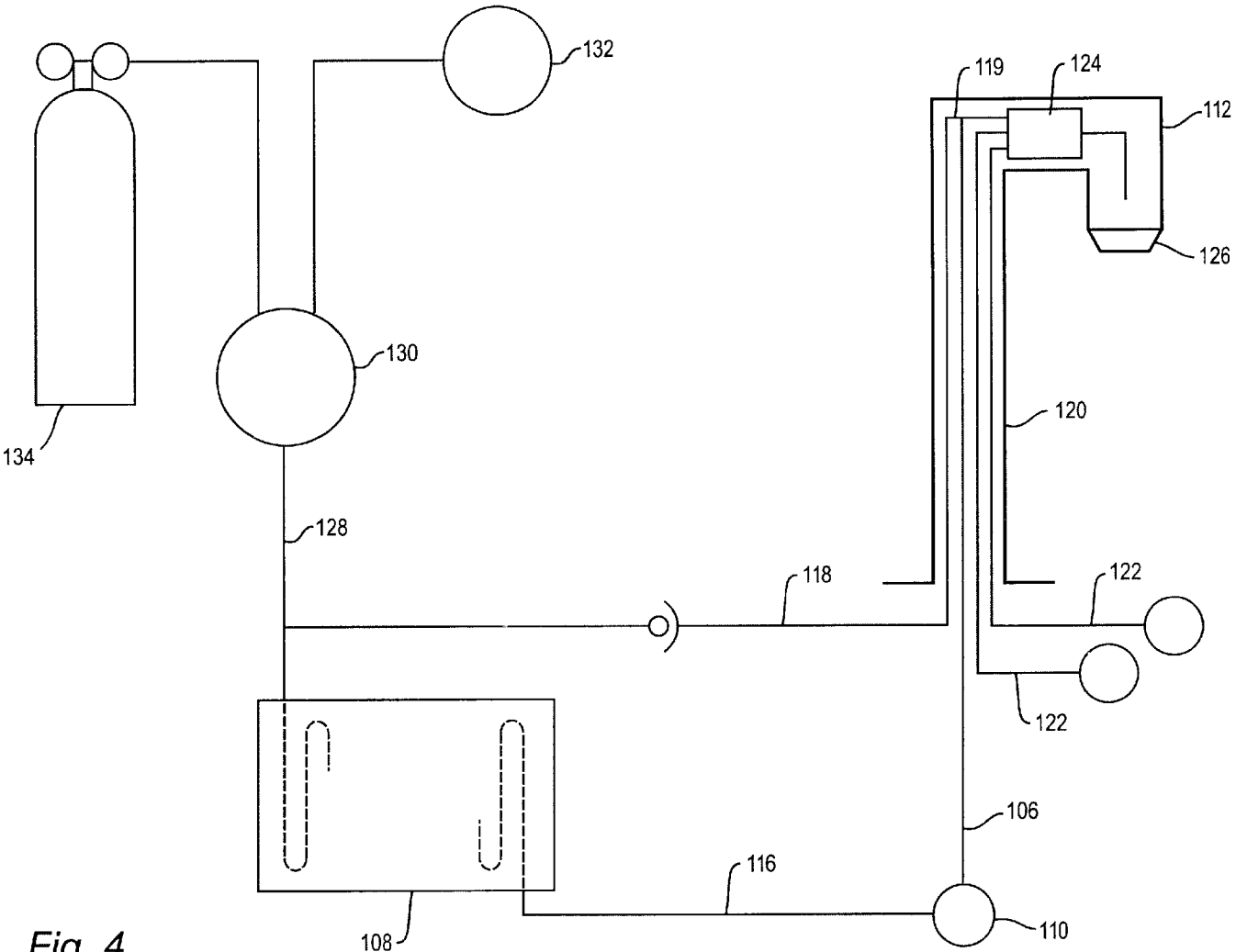
FIG. 4 is a schematic of a fluid circuit design for a bar gun.

FIG. 4 illustrates a bar gun cold carbonated water circulation system. A fluid circuit 106 is shown to include a cold plate 108, a circulation pump 110 and a dispenser, shown to be a bar gun 112. A supply 116 extends between the cold plate 108 and the bar gun 112. A return 118 extends from the bar gun 112 to the cold plate 108 with the ends of the supply 116 and the return 118 at the bar gun 112 being in continuous fluid coupling at a junction 119. Both the supply 116 and the return 118 extend in a bundle 120 of supply tubes 122 to the bar gun 112. The bar gun 112 includes a valve 124 in communication with the supply 116 which leads to a mixing spout 126. By extending the supply 116 and a return 118 to the bar gun 112, cold drinks will be dispensed regardless of the frequency of demand.

Figure 5:
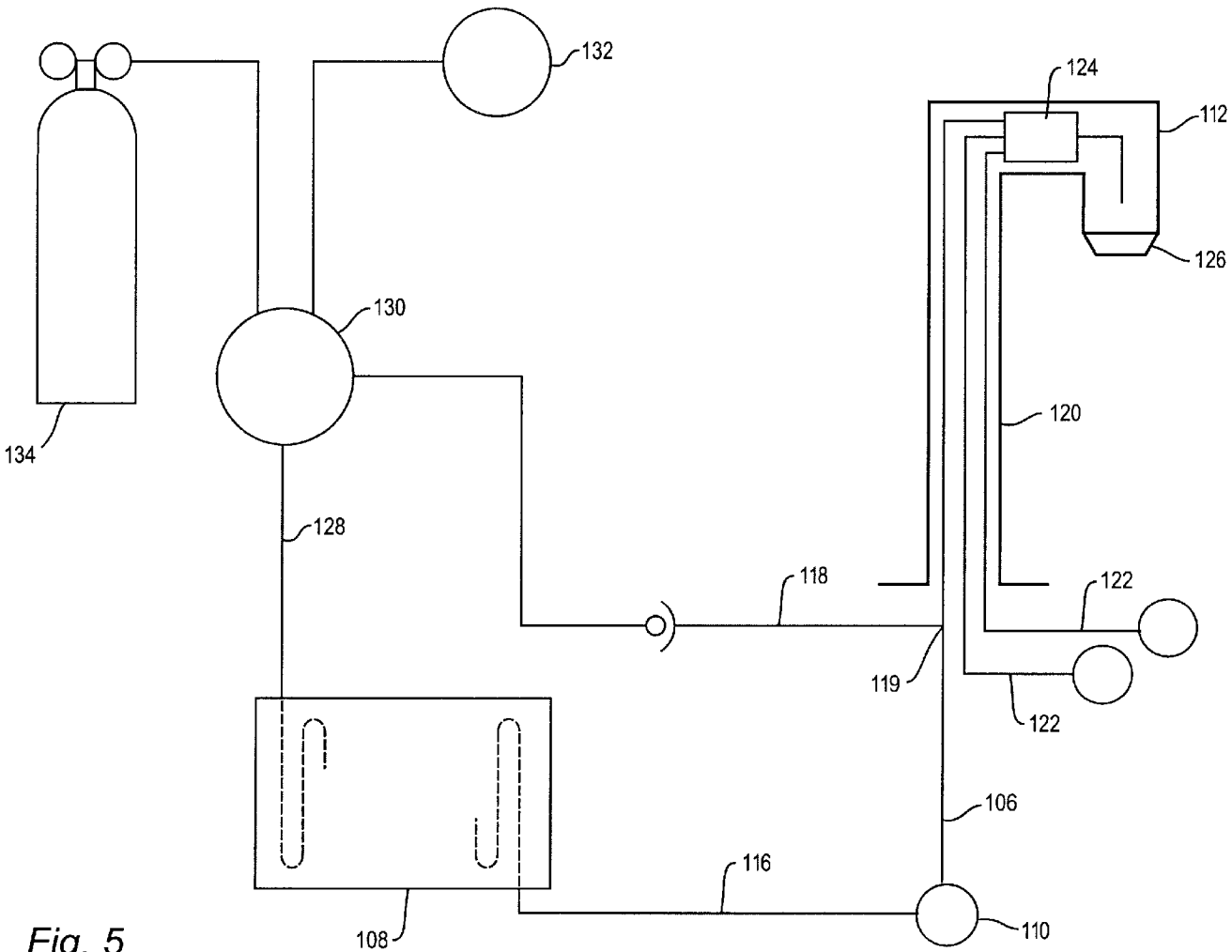
FIG. 5 is a schematic of a second fluid circuit design for a bar gun.

FIG. 5 illustrates another option for supplying the bar gun 112 with cold drinks regardless of the frequency of demand. In this embodiment, the supply 116 and the return 118 meet the junction 119 at the base of the bundle 120 rather than at the bar gun 112. This more remote location is possible where the volume within the supply line 127 between the base of the bundle 120 and the bar gun 112 is thermally insignificant to the drink contemplated. The supply line 127 within the bundle 120 may, for example, be ⅛" i.d. and 2½" long. The volume is less than ⅙ oz. Even with a bundle 120 of twice that length, the volume within the supply line would be less than ⅓ oz. The smallest volume contemplated for regular bar or fountain service is about a 3 oz. mixer for a bar drink. Thus, the stagnant volume that might be warmed to room temperature in the supply line 127 before a casual drink is dispensed is less than one-ninth the total volume of dispensed liquid. As the circulating liquid is contemplated to be at around 33° F., the rise in temperature resulting from such a warmed stagnant volume would only be a few degrees and well below the 40° F. which is the industry standard for carbonated fountain drinks.

With reference to both FIGS. 4 and 5, the pump 110 may be a small positive displacement pump to operate principally for circulation at fairly low flow rates as the pump 110 may be in either the supply 116 or the return 118. The pump 110, a check valve 127 or other flow restriction is provided to prevent distribution to the gun 112 through the return 118.

A supply of carbonated water is provided to the fluid circuit 106 through a carbonated water line 128. A carbonator 130 is coupled with a source of water 132 and a source of carbon dioxide 134. The return 118 may be coupled directly with the cold plate 108 as shown in FIG. 4 or with the carbonator 130 as shown in FIG. 5.

In operation, the pump 110 circulates carbonated water through the fluid circuit 106. This circulation provides chilled water to the gun 112. When the valve 124 is open, flow is provided through the supply 116. Either one-way pump flow through the pump 110 or a restriction in the return 118 prevents a supply of fluid to the bar gun 112 through the return 118. As fluid is dispensed, make-up carbonated water is provided from the carbonator 130. As the make-up fluid progresses through the cold plate 108 to the supply 116, it is chilled. The circulation through the fluid circuit 106, including the cold plate 108, insures a very cold supply system to the bar gun 112.

Accordingly, systems providing more controlled cooling using cold plates for drink dispensing have been disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A drink dispensing system comprising at least one dispenser valve;

a carbonator;

an ice storage bin including first heat transfer coils therein;

a carbonated water circulation circuit, the carbonator and the first heat transfer coils being in the carbonated water circuit, the dispenser valve being in fluid communication with the carbonated water circuit;

a pump capable of being coupled for fluid communication in the carbonated water circulation circuit, the carbonated water circulation circuit being a closed loop in operation including fluid communication fully about the closed loop in at least one direction among the carbonator, the dispenser valve and the first heat transfer coils independently of the pump.

2. The drink dispensing system of claim 1, the carbonated water circulation circuit having a parallel bypass around the pump.

3. The drink dispensing system of claim 2, the carbonated water circulation circuit having a check valve in the bypass against backflow.

4. The drink dispensing system of claim 3, the pump having a flow rate no greater than 35 gal./hr.

5. The drink dispensing system of claim 1, the carbonated water circulation circuit having a circulation rate of about 15 gal./hr.

6. The drink dispensing system of claim 1, the ice storage bin further including second heat transfer coils therein in the carbonated water circulation circuit, the dispenser valve being in fluid communication with the carbonated water circulation circuit between the first heat transfer coils and the second heat transfer coils.

7. The drink dispensing system of claim 6 further comprising a cold plate in the bottom of the ice storage bin, the first and second heat transfer coils being imbedded in the cold plate.

8. The drink dispensing system of claim 6, the first heat transfer coils being in fluid communication between the carbonator and the dispenser valve in the carbonated Water circulation circuit and the second heat transfer coils being in fluid communication between the carbonator and the dispenser valve in the carbonated water circulation circuit.

9. The drink dispensing system of claim 1 further comprising a source of water including a water inlet, and third heat transfer coils, the third heat transfer coils being in the ice storage bin and in fluid communication with the carbonator.

10. The drink dispensing system of claim 1 further comprising a source of water coupled for fluid communication with the carbonator including a water inlet and a water pressure booster including a water pressure booster valve, a water chamber, a carbon dioxide pressurized chamber and a movable wall between the water chamber and the carbon dioxide pressurized chamber, the movable wall being coupled with the water pressure booster valve;

a source of pressurized carbon dioxide in fluid communication with the carbon dioxide pressurized chamber and with the carbonator.

11. A drink dispensing system comprising at least one dispenser valve;

a carbonator;

an ice storage bin including first heat transfer coils therein;

a carbonated water circulation circuit, the carbonator and the first heat transfer coils being in the carbonated water circuit, the dispenser valve being in fluid communication with the carbonated water circuit;

a pump capable of being coupled for fluid communication in the carbonated water circulation circuit, the carbonated water circulation circuit being a closed loop in operation including fluid communication among the carbonator, the dispenser valve and the first heat transfer coils independently of the pump, the first heat transfer coils being in fluid communication between the carbonator and the dispenser valve in the carbonated water circulation circuit and the second heat transfer coils being in fluid communication between the carbonator and the dispenser valve in the carbonated water circulation circuit, the carbonated water circulation circuit between the carbonator and the dispenser valve through the first heat transfer coils including the pump coupled for fluid communication with the carbonated water circulation circuit and a parallel bypass around the pump, the carbonated water circulation circuit between the carbonator and the dispenser valve through the second heat transfer coils permitting flow in both directions.

12. A drink dispensing system comprising at least one dispenser valve;

a carbonator;

an ice storage bin including first heat transfer coils and second heat transfer coils therein;

a carbonated water circulation circuit, the carbonator, the first heat transfer coils and the second heat transfer coils being in the carbonated water circulation circuit, the dispenser valve being in fluid communication with the carbonated water circulation circuit between the first heat transfer coils and the second heat transfer coils, the first heat transfer coils being in fluid communication between the carbonator and the dispenser valve in the carbonated water circuit and the second heat transfer coils being in fluid communication between the carbonator and the dispenser valve in the carbonated water circuit.

13. The drink dispensing system of claim 12 further comprising a cold plate in the bottom of the ice storage bin, the first and second heat transfer coils being imbedded in the cold plate.

14. The drink dispensing system of claim 12 further comprising a pump fluid circuit including an inlet, an outlet and a pump between the inlet and the outlet, the inlet and the outlet capable of being coupled for fluid communication in the carbonated water circulation circuit between the carbonator and the first heat transfer coils.

15. The drink dispensing system of claim 12, the carbonated water circulation circuit between the carbonator and the dispenser valve through the second heat transfer coils permitting flow in both directions.

16. The drink dispensing system of claim 12 further comprising a source of water including a water inlet and third heat transfer coils, the third heat transfer coils being in the ice storage bin and coupled for fluid communication with the carbonator.

17. The drink dispensing system of claim 12 further comprising a source of water including a water inlet and a water pressure booster and coupled for fluid communication with the carbonator, the water pressure booster including a water pressure booster valve, a water chamber, a carbon dioxide pressurized chamber and a movable wall between the water chamber and the carbon dioxide pressurized chamber, the movable wall being coupled with the water pressure valve;

a source of pressurized carbon dioxide in fluid communication with the carbon dioxide pressurized chamber and with the carbonator.

18. The drink dispensing system of claim 17 further comprising a pressurized water supply line in fluid communication with the water pressure booster;

at least a second dispenser valve in fluid communication with the pressurized water supply line.

19. A drink dispensing system comprising a carbonated water circuit;

a first set of dispenser valves;

a second set of dispenser valves;

a first ice storage bin proximate to the first set of dispenser valves and including therein first heat transfer coils therethrough;

a second ice storage bin proximate to the second set of dispenser valves and including second heat transfer coils therethrough;

a carbonator in the carbonated water circuit, the first set of dispenser valves being in direct fluid communication with the carbonated water circuit between the first heat transfer coils and the second heat transfer coils, the second set of dispenser valves being in direct fluid communication with the carbonated water circuit between the second heat transfer coils and the carbonator;

a pump capable of being coupled for fluid communication in the carbonated water circuit.

20. The drink dispensing system of claim 19, the first ice storage bin further including therein third heat transfer coils in the carbonated water circuit between the first heat transfer coils and the second heat transfer coils, the first set of dispenser valves being in direct fluid communication with the carbonated water circuit between the first heat transfer coils and the third heat transfer coils.

21. The drink dispensing system of claim 20, the second ice storage bin further including therein fourth heat transfer coils in the carbonated water circuit between the second heat transfer coils and the carbonator, the second set of dispenser valves being in direct fluid communication with the carbonated water circuit between the second heat transfer coils and the fourth heat transfer coils.

22. The drink dispensing system of claim 19 further comprising a source of water including a water inlet, a supply pump, third heat transfer coils in the first ice storage bin and a water pressure booster valve in seriatim, the water pressure booster valve being in fluid communication with the carbonator, a water pressure booster including a water chamber, a carbon dioxide pressurized chamber and a movable wall therebetween and coupled with the water pressure booster valve;

a source of pressurized carbon dioxide in fluid communication with the carbon dioxide pressurized chamber and with the carbonator.

23. The drink dispensing system of claim 22 further comprising a noncarbonated dispenser valve in fluid communication with the water pressure booster.

24. The drink dispensing system of claim 19 further comprising a third set of dispenser valves;

a parallel carbonated water circuit coupled with the first heat exchange coil and the carbonator;

a third ice storage bin proximate to the third set of dispenser valves and including third heat transfer coils therethrough in the parallel carbonated water circuit between the first set of dispenser valves and the carbonator, the third set of dispenser valves being in direct fluid communication with the third heat transfer coils through the parallel carbonated water circuit.

25. The drink dispensing system of claim 24, the first ice storage bin having fourth heat transfer coils therein in the carbonated water circuit between the first heat transfer coils and the second heat transfer coils, the first set of dispenser valves being in direct fluid communication with the carbonated water circuit between the first heat transfer coils and the third heat transfer coils, the second ice storage bin having fifth heat transfer coils therein in the carbonated water circuit between the second heat transfer coils and the carbonator, the second set of dispenser valves being in direct fluid communication with the carbonated water circuit between the second heat transfer coils and the fifth heat transfer coils, the third ice storage bin having sixth heat transfer coils in the parallel carbonated water circuit between the third heat transfer coils and the carbonator, the third set of dispenser valves being in direct fluid communication with the parallel carbonated water circuit between the third heat transfer coils and the sixth heat transfer coils.

26. The drink dispensing system of claim 19, the carbonated water circuit permitting flow in both directions between the carbonator and the carbonated water circuit between the first and second set of heat transfer coils.

27. A drink dispensing system comprising a first set of dispenser valves;

a second set of dispenser valves;

a carbonator;

a first parallel carbonated water circuit extending from and returning to the carbonator;

a second parallel carbonated water circuit extending from and returning to the carbonator;

a first ice storage bin proximate to the first set of dispenser valves and including first and second heat transfer coils therein and in the first parallel carbonated water circuit, the first set of dispenser valves being in direct fluid communication with the first carbonated water circuit between the first heat transfer coils and the second heat transfer coils;

a second ice storage bin proximate to the second set of dispenser valves and including third and fourth heat transfer coils therein and in the second parallel carbonated water circuit, the second set of dispenser valves being in direct fluid communication with the second carbonated water circuit between the third heat transfer coils and the fourth heat transfer coils.

28. The drink dispensing system of claim 27 further comprising a third set of dispenser valves;

a third parallel carbonated water circuit extending from and returning to the carbonator;

a third ice storage bin proximate to the third set of dispenser valves and including fifth and sixth heat transfer coils therein and in the third parallel carbonated water circuit, the third set of dispenser valves being in direct fluid communication with the third carbonated water circuit between the fifth heat transfer coils and the sixth heat transfer coils.

29. The drink dispensing system of claim 27 further comprising first and second pumps capable of being coupled for fluid communication in the first and second parallel carbonated water circuits, respectively.

30. The drink dispensing system of claim 29, the first and second parallel carbonated water circulation circuits being closed loops and in operation including fluid communication among the carbonator, the first and second dispenser valves, respectively, and the first and second and the third and fourth heat transfer coils, respectively independently of the first and second pumps, respectively.

31. The drink dispensing system of claim 30, the first and second carbonated water circulation circuits each having a parallel bypass around the first and second pumps, respectively.

32. The drink dispensing system of claim 30, the first and second carbonated water circulation circuits between the carbonator and the first and second dispenser valves, respectively, through the second and fourth heat transfer coils permitting flow in both directions.

* * * * *